US005431484A

United States Patent [19]

Zahoransky et al.

[11] Patent Number: 5,431,484

[45] Date of Patent: Jul. 11, 1995

[54] PROCESS AND APPARATUS FOR PRODUCING BRUSHES

[75] Inventors: Heinz Zahoransky, Todtnau; Otmar Horl, Freiburg; Benno Dërflinger, Todtnau, all of Germany

[73] Assignee: Anton Zahoransky, Todtnau, Germany

[21] Appl. No.: 236,937

[22] Filed: May 2, 1994

[30] Foreign Application Priority Data

May 4, 1993 [DE] Germany ..... 43 14 692.9

[51] Int. Cl.[6] ..... A46D 1/04

[52] U.S. Cl. ..... 300/2; 300/10; 300/21

[58] Field of Search ..... 300/2, 11, 21, 10

[56] References Cited

U.S. PATENT DOCUMENTS 4,807,938 2/1989 Weihrauch ..... 300/21
4,979,782 12/1990 Weihrauch ..... 300/4
5,176,427 1/1993 Weihrauch ..... 300/10

FOREIGN PATENT DOCUMENTS 3820372 12/1989 Germany .

*Primary Examiner*—John Husar
*Attorney, Agent, or Firm*—Panitch Schwarze Jacobs & Nadel

[57] ABSTRACT

An apparatus (1) is used in the production of brushes for the preparation of completely processed bristle bundles. Bristle strand material (4) is thereby conveyed with the aid of a feed mechanism (5) to a grinding device (6) where its free ends are processed into what will become the ultimate useful ends. By this processing, the free length of the bristle strand ends, and thus their ability to deflect laterally during grinding as well, can be exactly adjusted to this work procedure. This processing can be adapted to differing bristle material, or even adapted to differences in the desired rounding off results. The actual length of the final bristle bundles does not play a role in this, since the cutting of the bristle bundles to length does not take place until a following work step.

14 Claims, 4 Drawing Sheets

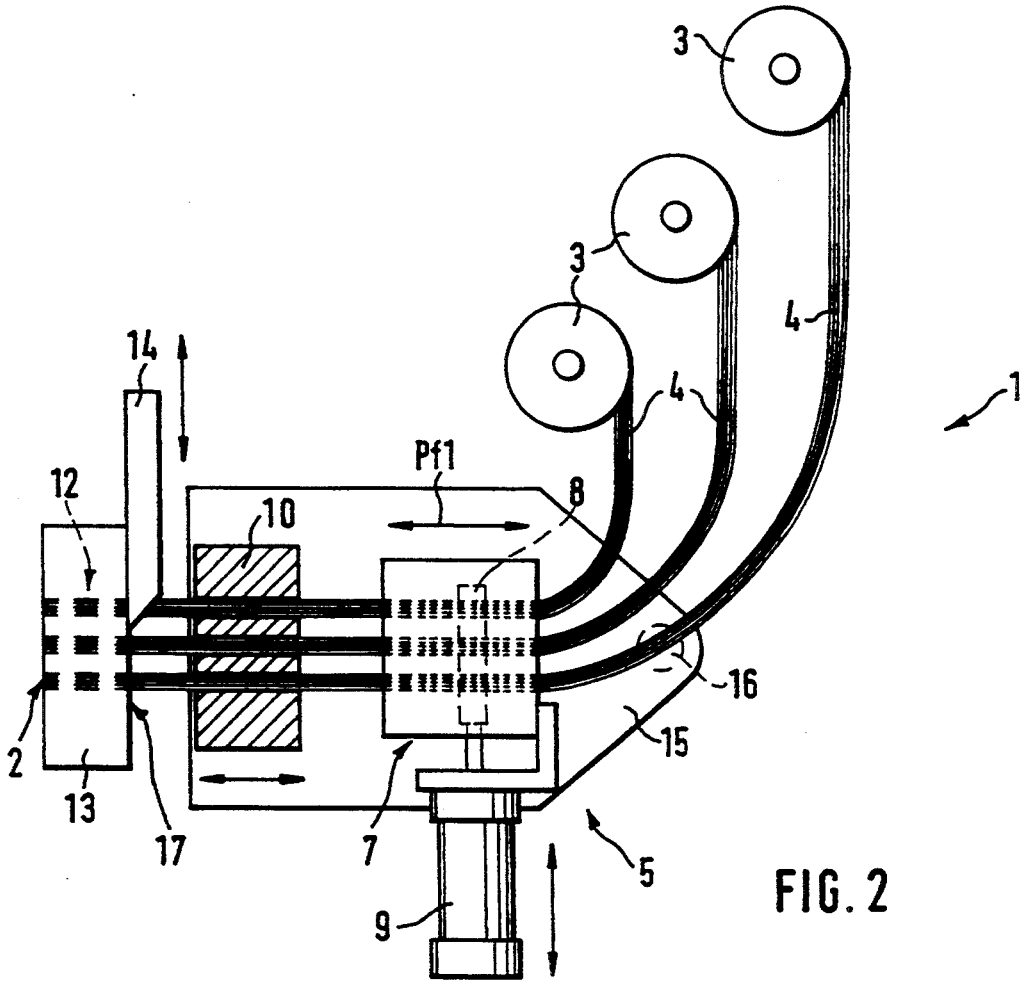
FIG. 2
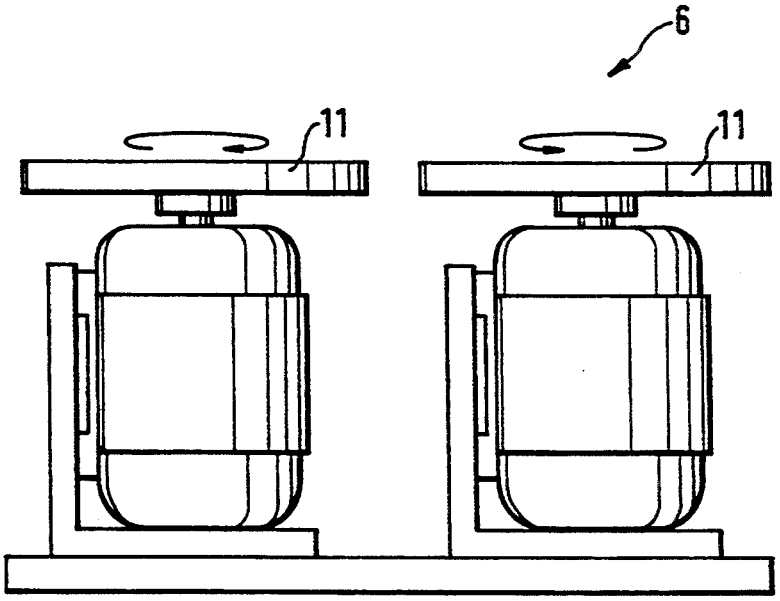

PROCESS AND APPARATUS FOR PRODUCING BRUSHES

FIELD OF THE INVENTION

The invention relates to a process for the production of brushes that have bristle bundles with individual bristles that have been processed, and in particular ground, at their useful ends. In addition, the invention relates to an apparatus for the production of brushes having a brush body with bristles joined to it, whereby the apparatus has a feed mechanism for bristle bundle material, at least one grinding device for rounding off the useful ends of the bristles, and possibly additional processing devices.

BACKGROUND OF THE INVENTION

In the production of brushes, after the bristle bundles have been inserted into the brush body, these bristle bundles are ground at their useful ends in order to obtain rounded off ends. This is necessary because, after they have been cut to length or sheared off the useful ends have sharp edges at the site of the cut. These sharp edges are undesirable, especially in the case of toothbrushes where they would lead to injury to the gums. For this reason, the rounding off of the useful ends has particular significance and importance, and the result of the rounding off is a fundamental quality factor for brushes, and toothbrushes in particular.

As already mentioned at the outset, the bristle ends can be sheared off and ground after the bristle bundles have been inserted into the brush bodies. In the case of brushes with so-called "welded" bristles, processing the bristle bundles before their joining with the brush body is already known from DE 38 20 372. To do this, the bristle bundles are held in clamping devices or the like, and their useful ends are ground and possibly given other additional processing steps. After this processing, the bristle bundles are conveyed to the brush body and joined to it.

In the case of brushes with comparatively long bristle bundles, this procedure can be employed largely without problem. What is a problem, however, is the processing of very short bristle bundles, which are used inter alia, for toothbrushes. Particularly in the case of bristle fields that are contoured and that have in certain areas bristle bundles which are shorter compared to the "normal bristle bundles," such bristle bundles are held for processing only with difficulty.

For the processing, and in particular for rounding off, the ends of the bristle bundles must project far enough beyond the clamping location that they are able to deflect laterally during the grinding. This is necessary in order to achieve sufficient rounding off of the ends.

It would be possible of course, in the case of processing short bristle bundles with small lateral deflection capability, to make use of shaped grinding tools or the like. However, such tools are expensive and also require exact positioning and guidance relative to the bristle bundle ends. Further, the result of the grinding is not satisfactory in all cases.

By means of the predetermined free clamping length, the varying lengths of the bristle bundles also yield correspondingly different rounding off results as well, since, due to the different free projecting lengths, the useful ends can also have different lateral deflections. Corresponding differences in quality of the bristles, even within a common bristle field, are the undesired consequence.

Grinding devices with essentially flat, rotating grinding surfaces have proven very effective in practice, whereby even large-area bristle fields or multiple bristle fields can be shaped simultaneously. In this case, special positioning is not necessary. In the case of flat or essentially flat grinding surfaces, though, sufficient lateral deflection of the bristle bundle ends is required for a good rounding off result.

SUMMARY OF THE INVENTION

An object of the present invention is to create a process and an apparatus of the type described in the Field of the Invention, whereby bristle bundles of varying lengths, and even very short bristle bundles, can be shaped on their ends, and in particular rounded off, before being joined with a brush body. In doing this, it should be possible to make use, to the greatest extent possible, of already existing processing equipment.

To achieve this object, it is particularly proposed in accordance with the invention that bristle bundle material be conveyed to a holding and forward-feed device in the form of a strand, that the length of the free end of the strand projecting beyond the holding and forward-feed device be dimensioned for a preset lateral deflection of the bristle bundle and the individual bristles during a shaping of the bundle's ends, that following this the projecting strand end be ground, that a bristle bundle then be cut to length from the strand, and after possible additional intermediate processing steps, be joined with a brush body.

In using this procedure, the user is completely free from the ultimate bristle bundle length, since the processing of the ultimate useful ends takes place while they are still on the bristle bundle strand. The free projecting length provided by a clamping or the like can thereby be matched to the processing requirements without taking into consideration the final length of the bristle bundles. The presetting of the length operates according to the required rounding off, taking into consideration, among other things, even the bristle material being used, whereby a longer projecting length yields a more pronounced rounding off, while a shorter projecting length yields a correspondingly flatter rounding off. Thus, independent of the final bristle bundle length, all of the bristle bundle ends can be shaped uniformly so that they all have a constant rounded off characteristic, even bristle bundles of different lengths.

With the process according to the invention, there is the possibility of a bristle bundle material strand having a cross-section which is a multiple of individual bristle bundle cross-sections being first separated into individual strands corresponding to the individual bristle bundle cross-sections, and then the individual strands being conveyed to a processing step. On the other hand, however, according to another variation of the process in accordance with the invention, there is also the possibility of a bristle bundle material strand with a multiple cross-sectioned bundle of individual bristle bundles being ground or processed in a similar way as a whole at its free end, and then being separated into individual strands or bristle bundles. In both cases, the ends of the bristle material strand that project for the processing can be rounded off to the desired extent through adjustment of the projecting length.

The invention also relates to an apparatus for carrying out the process of the invention. This apparatus is particularly characterized by a feed mechanism for the feeding of the bristle strand material having been configured with the grinding device for the grinding and rounding off of the strand ends immediately adjoining this feed mechanism.

As already mentioned, the useful ends of the bristle bundles can be processed while they are still on the strand, independently of the final length of the bristle bundle. No clamping problems arise in this connection, even during the processing of very short bristle bundles, because the strand is still attached to the rear end of the bristle bundle segment, and the projecting length can be determined virtually at will and, in particular, be matched to the technical requirements.

By means of the variable projecting length of the strand ends beyond the clamping or holding position, the rounding off effect can be varied over a wide range. In this way, it is possible without problems to adapt to varying requirements on the one hand, and to different bristle materials on the other.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the largely schematic drawings:

FIG. 2 shows the apparatus of FIG. 1 in another working position;

DETAILED DESCRIPTION OF PREFERRED EMBODIMENTS

Figure 1:
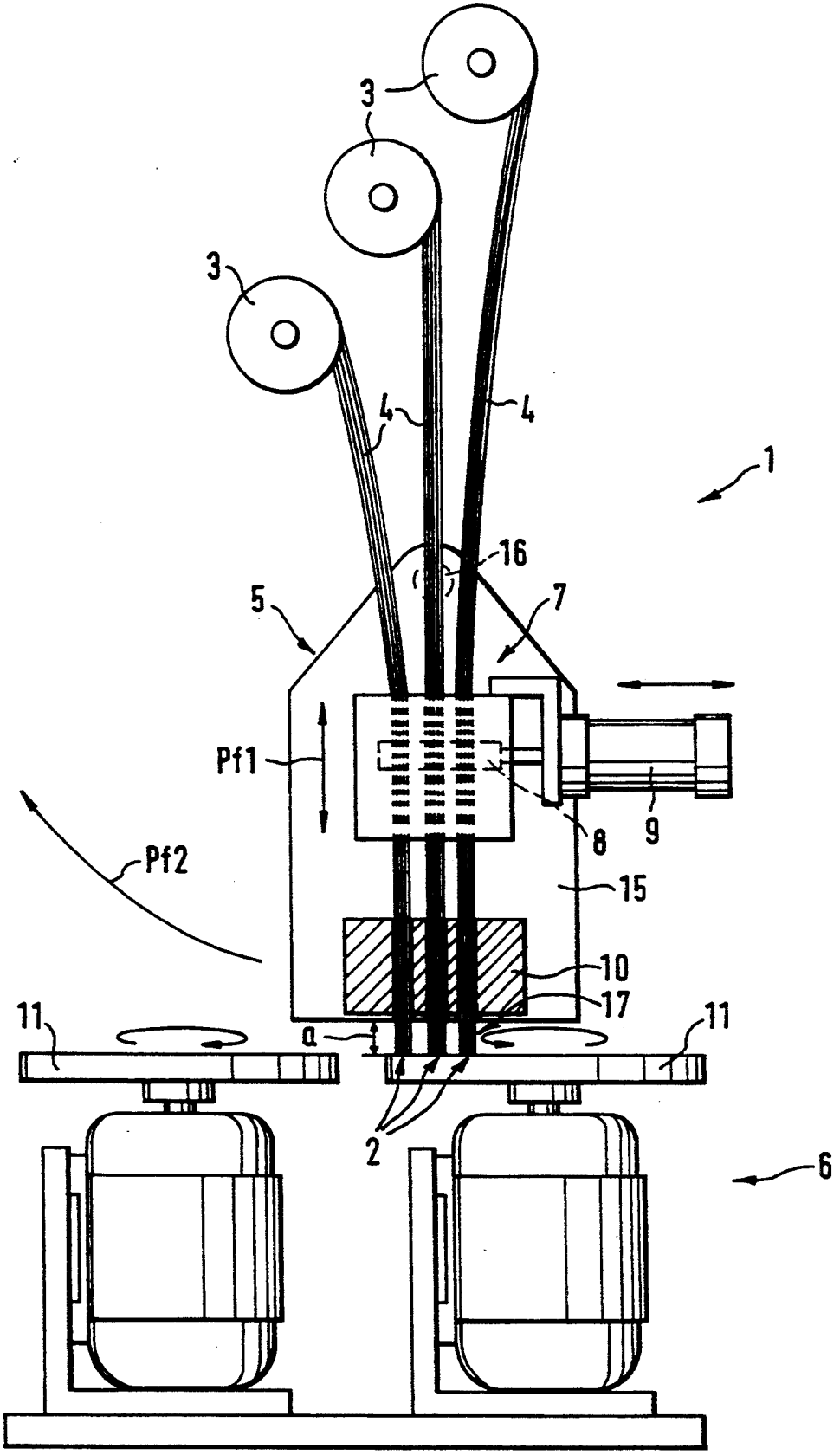
FIG. 1 illustrates an apparatus for feeding and grinding of bristle strand material.

An apparatus 1 shown in FIGS. 1 and 2 is used for the preparation of bristle bundles being readied for joining with a brush body in the production of brushes. The bristle bundles are completely processed thereby, and in particular are cut to the appropriate length and rounded off at their useful ends 2 by grinding.

As can be seen in the Figures, the bristle material is fed from one or more rolls 3, in practical terms as an endless strand or as several endless strands 4. The number of bristle strands conveyed can correspond to the number of bristle bundles to be found in a bristle field. However, there is also the possibility of processing partial quantities thereof.

The apparatus 1 has a feed mechanism 5, by means of which the bristle strands 4 can be conveyed to a grinding device 6 for processing of the free strand ends. The feed mechanism 5 has a forward feed device 7 that can position the bristle strand ends for processing with the aid of a clamping grip 8, which is connected with a reciprocating drive, that is not represented in more detail here, and which can be displaced in the direction of the forward feed. The clamping grip 8, which is connected with a reciprocating cylinder 9, can take hold of the bristle strands and clamp them securely, and the bristle strand ends can then be conveyed to the grinding device 6 by means of a displacement of the entire forward feed device 7, as indicated by the double arrow PF1 in FIG. 1.

A swage block 10 used for guiding the bristle strands 4 also connects to the feed mechanism 5 at the other end at a distance from the clamping grip 8. The free projecting length a of the bristle strand ends beyond the swage block 10 is adjustable, and can be matched to the current requirements of the processing. In particular, the projecting length a can be so dimensioned that, during the rounding off of the bristle ends by grinding, a lateral deflection can be set that is sufficient for the grinding. The amount of this deflection basically determines the result of the rounding off.

The adjustability of the projecting length can thus be oriented exclusively towards the processing requirements, and is independent of the subsequent bristle length. In particular, even very short bristle bundles can be produced in this way, which, in the extreme case, are even shorter than the projecting length a that is provided for the processing. This is possible because the grinder processing of the useful ends 2 has already taken place on the endless bristle strands, which, following this processing, can then also be positioned appropriately for the cutting of the bristle bundles to the bristle bundle length required in each case.

In adjusting the optimum projecting length a of the bristle bundle strand ends, the material characteristics and the thickness of the bristles can also be taken into consideration in an advantageous way. The adjustment is usually carried out in such a way that the bristle fibers can take up a canted position at an angle of about 30 to 40 degrees during the grinding operation. With the usual fiber diameter, a free projecting length a of from 7 to 8 mm is necessary. In particular, contoured bristle fields have significantly shorter bristles in some areas, so that up until now optimum rounding off was not possible with such short bristle bundles.

For the grinding device 6, it is preferable if essentially flat, rotating grinding discs 11 are used. In place of the rotating grinding discs shown in the embodiment, other grinding devices with flat grinding surfaces can be provided as well. For example, belt grinders can be used that, in addition, rotate around an axis arranged transverse to the grinding plane. With such grinding devices, a number of bristle strand ends can be processed at the same time in a single grinding operation. In the embodiment shown, two grinding discs 11 arranged alongside each other are provided as the grinding device 6; these grinding devices can be configured for rough preliminary grinding and fine finish grinding.

Following the rounding off of the bristle ends, bristle bundles 12 are cut from the ends of the bristle strands 4 (FIG. 2). To do this, the useful ends 2 of the bristle strand ends are pushed forward into a transport swage block 13. This insertion and longitudinal positioning can in turn be done by means of the feed mechanism 5. Following the severing of the bristle bundles, which are found in the transport swage block 13, from the strands 4 by means of a blade 14, the bristle bundles 12 can be conveyed to an injection mold (not shown) and there be joined with a brush body.

In the embodiment shown, both the feed mechanism 5 and the swage block 10 are mounted on a swivel plate 15, which can be swivelled around a pivot bearing 16 as indicated by the arrow PF2 (see FIG. 1), so that the free ends 17 of the bristle strands 4 can be placed in the swivelled position adjacent the grinding device 6, shown in FIG. 1, as well as in the swivelled position adjacent the cutting device and the transport swage block 13, shown in FIG. 2.

As mentioned previously, the processing of an individual bristle strand 4, as well as the simultaneous processing of several bristle strands, can be carried out at the same time. The number of bristle strands processed simultaneously can also correspond to the number of bristle bundles that are to be joined to a brush body, that is the entire bristle field.

In order to be able to fill with bristle bundles 12 a transport swage block 13 having the correct number of receiving holes necessary for a complete brush, but on the other hand, to only process bristle strands that are fed in from three rolls 3, for example, the transport swage block 13 can also be positionable relative to the swage block 10, so that all of the holes of the transport swage block 13 are filled with bristle bundles one after the other, and only then is a transport carried out of all of the bristle bundles of a bristle field to an injection mold.

Figure 3:
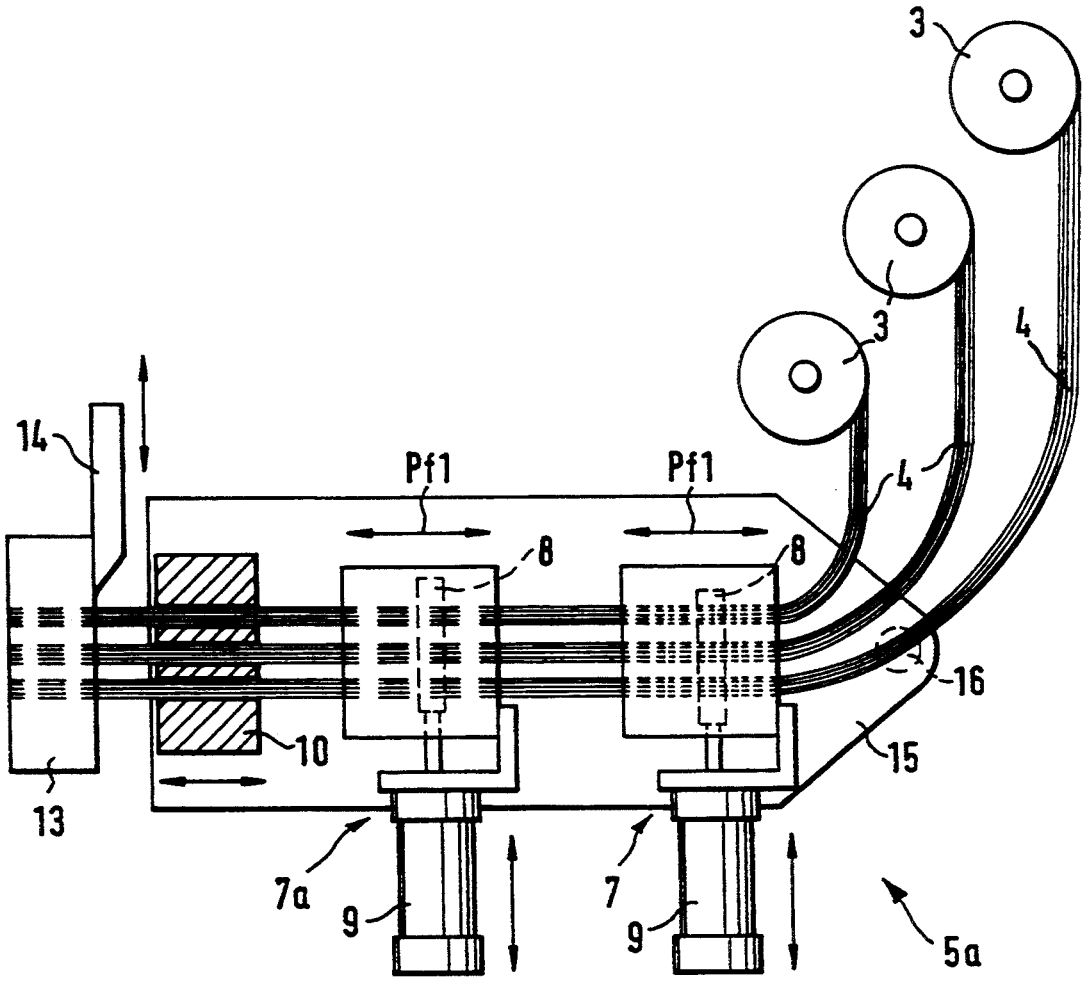
FIG. 3 shows another embodiment of an apparatus that is a somewhat modified version of those in FIGS. 1 and 2.

FIG. 3 shows a feed mechanism 5*a* with which the possibly varying forward feed movements of the bristle strands 4 for the grinding of the bristle ends, on the one hand, and for the positioning for severing of the bristle bundles 12, on the other hand, are carried out by separate forward feed devices 7, 7*a*. In the event of differing forward feed distances for these two processing steps, fixed forward feed distances can be provided for each of these forward feed devices 7, 7*a*. In addition, there is then also the possibility of alternately activating the forward feed devices in order to prevent the bristle strands from being carried along during a return movement of one of the forward feed devices. In addition, this also favors a very exact positioning of the bristle strand ends for grinding and especially for cutting the bristle bundles 12 to length.

In the embodiments shown the given cross-section of the bristle strands 4 also corresponds to the cross-section of the later bristle bundles 12. Each of the individual bristle strands 4 comes respectively from supply rolls 3. If so desired, a bristle bundle material strand having a cross-section which is a multiple of the individual bristle bundle could first be separated into individual strands corresponding to the individual bristle bundle cross-sections, and then, as described previously, the individual strands could be moved forward to a processing step. On the other hand, a bristle bundle material strand having a cross-section which is a multiple of an individual bristle bundle can also be ground and similarly processed as a whole at its free end, and then, following that, the full strand can be separated into individual strands or bristle bundles.

Figure 4:
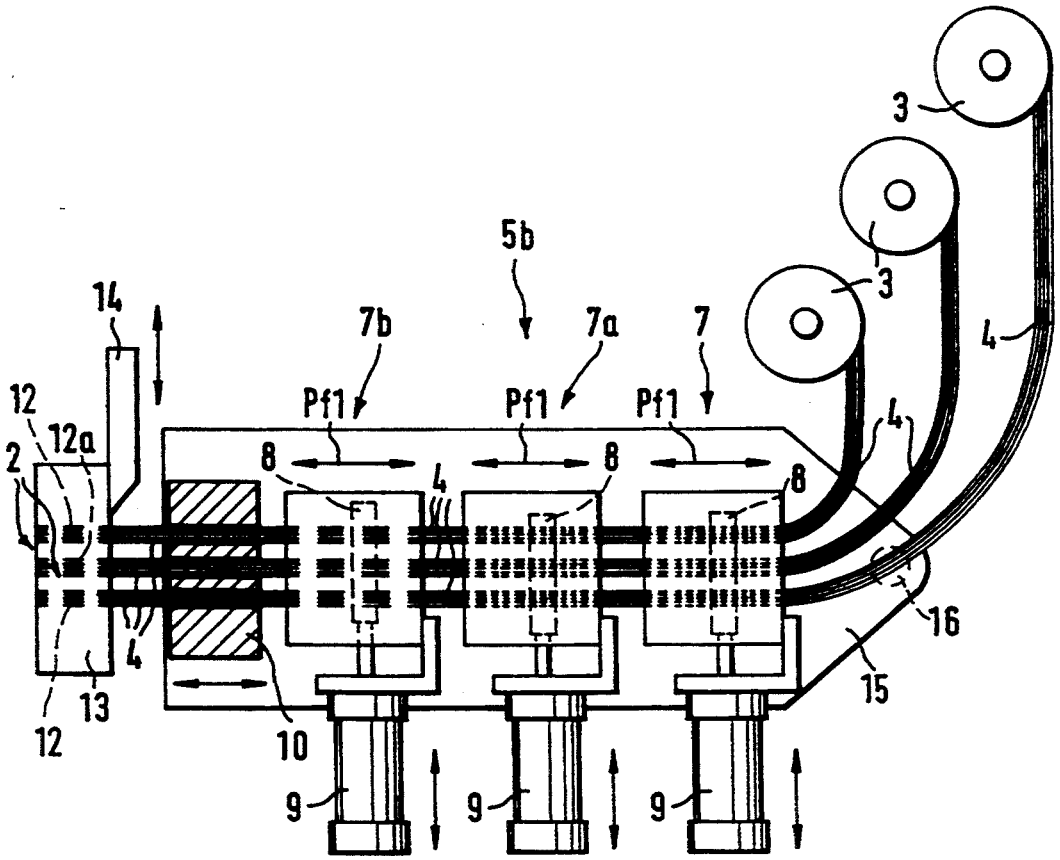
FIG. 4 illustrates another embodiment of the apparatus in accordance with the invention for the production and processing of bristle bundles of varying lengths.

With the help of the feed mechanism 5*b* shown in FIG. 4, processed bristle bundles 12 can be produced in different lengths. In this embodiment, three forward feed devices 7, 7*a*, 7*b* are provided. As previously, the forward feed device 7 takes over the feeding of the bristle strands 4 for grinding of the bristle ends, while the forward feed devices 7*a*, 7*b* are configured for the gripping of differing bristle strands 4, on the one hand, as well as for forward feed lengths that are independent of and differ from one another, on the other hand. For example, only the two outer bristle strands are gripped and transported by the forward feed device 7*a* and its clamping grip 8. The forward feed device 7*b* is configured for gripping and transporting the middle bristle strand. As can be seen with the transport swage block 13, the forward feed device 7*a* carries out a shorter forward feed path than forward feed device 7*b* does, so that the useful ends 2 are then found within the transport swage block 13 at different planes. Following the severing by the blade 14, bristle bundles 12, 12*a* of varying lengths are thus available. It is thus possible to prepare for joining with a brush body bristle bundles which then provide a correspondingly contoured bristle field due to their varying lengths.

It should also be mentioned that each of the clamping grips 8 can be formed by at least two swage blocks or the like, which have through holes for the bristle strand material, the holes being aligned with each other, and which can each be moved transverse to the through holes into a clamping position relative to one another by means of activation of the reciprocating cylinder 9.

Before the bristle bundles 12, 12*a* are joined with a brush body, the bristle bundles can still be profiled by, for example, displacing the bristles within one bristle bundle.

There also exists the possibility of processing different bristle strand material at the same time. When this is done, the individual bristle strands can differ with respect to the number of fibers, the color, the fiber thickness, the type of material, and even the fiber cross-section.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A process for the production of bristle bundles for brushes with individual bristles processed at their useful ends, comprising conveying bristle bundle material in a form of a strand (4) to a holding and forward-feed device (5,7), dimensioning a projecting length (a) of a free strand end (17) beyond the holding and forward-feed device for a preset lateral deflection of the bristle bundle material during a processing of the strand end, processing the projecting strand end, and cutting a bristle bundle (12, 12*a*) from the strand (4) to a desired length for joining with a brush body.

2. Process according to claim 1, wherein the bristle bundle material strand has a cross-section which is a multiple of an individual bristle bundle (12), the strand is first separated into individual strands (4) corresponding to individual bristle bundle cross-sections, and individual strands are then conveyed to a processing step.

3. Processing according to claim 1, wherein the bristle bundle material strand has a cross-section which is a multiple of an individual bristle bundle (12, 12*a*), the strand is first processed as a whole at its free end, and then the strand is separated into individual bristle bundle strands.

4. Process according to claim 1, wherein following the processing step, individual strands (4) are conveyed to a separating device by means of different forward feed lengths.

5. Process according to claim 1, wherein said processing comprises grinding the bundle ends.

6. Process according to claim 5, wherein useful bristle ends are rounded off by said grinding.

7. Process according to claim 1, wherein after cutting to a desired length, the bristle bundle is subjected to at least one additional processing step.

8. An apparatus for the production of bristle bundles for brushes, comprising a feed mechanism (5, *5a*, *5b*) for bristle bundle material and at least one grinding device (6) for grinding and rounding useful ends of bristles in the bundles, wherein the feed mechanism (5, *5a*, *5b*) is configured for feeding of the bristle bundle material in a form of a strand (4), and the grinding device (6) immediately adjoins said feed mechanism nearest an end of the strand, whereby the grinding and rounding is carried out on the end of the strand.

9. Apparatus according to claim 8, wherein the feed mechanism (5, *5a*, *5b*) comprises a holding and forward-feed device for bristle strand material (4) and the holding device includes a swage block (10) with at least one through guide hole for bristle strands (4).

10. Apparatus according to claim 9, wherein at least one grinding disc (11) is adjustably arranged at a distance (a) from the swage block (10) of the holding device.

11. Apparatus according to claim 9, wherein the feed mechanism (5, *5a*, *5b*) is arranged to be movable with its swage block (10) between positions adjacent the grinding device (6) on the one hand, and a cutting device on the other hand.

12. Apparatus according to claim 8, wherein the feed mechanism (5, *5a*, *5b*) includes a forward feed device (7, *7a*, *7b*) having, for at least one bristle strand (4), at least one clamping grip (8) joined to a reciprocating drive and movable in a forward feed direction.

13. Apparatus according to claim 12, comprising several forward feed devices (7, *7a*, *7b*) movable in a longitudinal (feed) direction independently of one another and arranged one after the other in a transport direction, each forward feed device being provided with a clamping grip (8).

14. Apparatus according to claim 13, wherein each clamping grip (8) is formed by at least two swage blocks having through holes for bristle strand material, said blocks being aligned with each other and being movable relative to each other transverse to the through holes and into a clamping position.

* * * * *